United States Patent [19]

Goloff et al.

[11] 4,080,121

[45] Mar. 21, 1978

[54] JOINT SEALING FOR ENGINE HOUSINGS

[75] Inventors: Alexander Goloff, East Peoria; Tsu Pin Shyu, Peoria, both of Ill.

[73] Assignee: Caterpillar Tractor Co., Peoria, Ill.

[21] Appl. No.: 806,293

[22] Filed: Jun. 13, 1977

Related U.S. Application Data

[63] Continuation of Ser. No. 650,222, Jan. 19, 1976, abandoned.

[51] Int. Cl.[2] ..... F01C 19/00; F02F 1/00

[52] U.S. Cl. ..... 418/149; 92/169; 123/193 CH; 277/207 R

[58] Field of Search ..... 418/149, 270; 123/193 CH, 193 C, 193 H, 195; 92/169, 171; 29/156.4 R, 446; 403/253, 254, 255, 258, 388; 277/207 R, 235 B

[56] References Cited

U.S. PATENT DOCUMENTS

| | | | |
|---|---|---|---|
| 1,484,516 | 2/1924 | MacFarland | 92/169 |
| 1,638,183 | 8/1927 | Bylger | 418/53 X |
| 1,968,110 | 7/1934 | Walker | 123/193 CH |
| 2,804,866 | 9/1957 | Kloss | 123/193 CH |
| 2,851,020 | 9/1958 | Dolza | 92/171 X |
| 3,942,807 | 3/1976 | Dinger | 277/235 B |
| 3,989,421 | 11/1976 | Ritchie | 418/53 |

FOREIGN PATENT DOCUMENTS

| | | | |
|---|---|---|---|
| 227,026 | 1/1961 | Austria | 123/193 CH |
| 2,365,413 | 11/1974 | Germany | 123/193 H |
| 947,961 | 1/1964 | United Kingdom | 123/193 CH |

*Primary Examiner*—Carlton R. Croyle
*Assistant Examiner*—Leonard Smith
*Attorney, Agent, or Firm*—Wegner, Stellman, McCord, Wiles & Wood

[57] ABSTRACT

An improved mechanism such as an engine, pump, compressor, or the like, including two abutting housing members sealingly engaging each other and defining a chamber receiving a piston. The members are clamped together and at least one of the members is relieved over a portion of its area of abutment with the other, the relieved portion being remote from the chamber. Upon clamping, excellent contact stress at the boundary of the chamber is established to preclude gas leakage in spite of yielding or fretting of the parts during operation.

7 Claims, 7 Drawing Figures

JOINT SEALING FOR ENGINE HOUSINGS

This is a continuation, of application Ser. No. 650,222 filed Jan. 19, 1976, now abandoned.

BACKGROUND OF THE INVENTION

This invention relates to mechanisms such as engines, compressors, pumps, or the like, of either the rotary or the reciprocating variety. More specifically, the invention relates to improved means for ensuring the presence of adequate contact stress at the interface of two housing components defining a chamber to preclude gas leakage.

In housings for pumps, engines, compressors, or the like, as, for example, in reciprocating mechanisms of the foregoing type, cylinder heads are commonly attached to the block by means of cap screws or studs with a gasket interposed between the two elements. Where the cylinder is defined by a cylinder liner, it is often formed to project from the surface of the block an amount on the order of a few thousandths of an inch. The usual interposed gasket is formed to be somewhat thicker in the vicinity of the liner, generally by embedding a wire ring within the gasket in a position to be aligned with the projecting portion of the cylinder liner. As a consequence, the gasket will load more heavily at its point of contact with the liner projection and the head, thus preventing leakage of high pressure gas during operation.

In other constructions, the gasket may be made more rigid at its point of alignment with the cylinder liner. The foregoing approaches taken by the prior art are relatively sensitive to manufacturing tolerances. Not only is precision of manufacturing of the various parts of considerable concern, but one must also consider the respective rigidities of the elements being clamped and the ability of the clamping means, normally bolts, and gasket elements to store enough energy in the form of elastic deformation so that contact stress sufficient to maintain a seal is maintained in spite of yielding or fretting of the parts over a prolonged period.

In typical rotary mechanisms, relatively low contact stresses are present between intermediate housing and end housing components and O-rings are typically employed to establish a seal. However, because the stresses are low, combustion or compressed gases may leak into the gap and cause deterioration of the O-rings, resulting in water from a cooling system seeping into the operating chamber of the mechanism. Even resort to high temperature resistant polymers, as the material for formation of the O-ring, has not cured the problem.

SUMMARY OF THE INVENTION

It is the principal object of the invention to provide a new and improved mechanism such as an engine, pump, compressor, or the like. More specifically, it is an object of the invention to provide improved means for establishing adequate contact stresses between housing components at the edge of a chamber in such mechanisms.

An exemplary embodiment of the invention achieves the foregoing object in an engine, pump, compressor, or the like, including two abutting housing members sealingly engaging each other and defining a chamber receiving a piston. Means, such as bolts, are provided to clamp the members together. At least one of the members is relieved over a portion of its area of abutment with the other member. The relieved portion is remote from the chamber. As a consequence, upon tightening of the clamping means, edge loading between the parts is the highest adjacent the chamber, with the result that desirable high contact stresses are maintained thereat. Such stresses are sufficiently high that concern for manufacturing tolerances is minimal and good sealing is provided.

According to one embodiment of the invention, the relieved portion may be defined by a step. According to another embodiment of the invention, the relieved portion is defined by a taper.

The invention may be employed in connection with cylinder heads, intermediate housing members disposed between end members and replaceable liners in reciprocating and rotary mechanisms.

Other objects and advantages will become apparent from the following specification taken in connection with the accompanying drawings.

DESCRIPTION OF THE PREFERRED EMBODIMENTS

Figure 1:
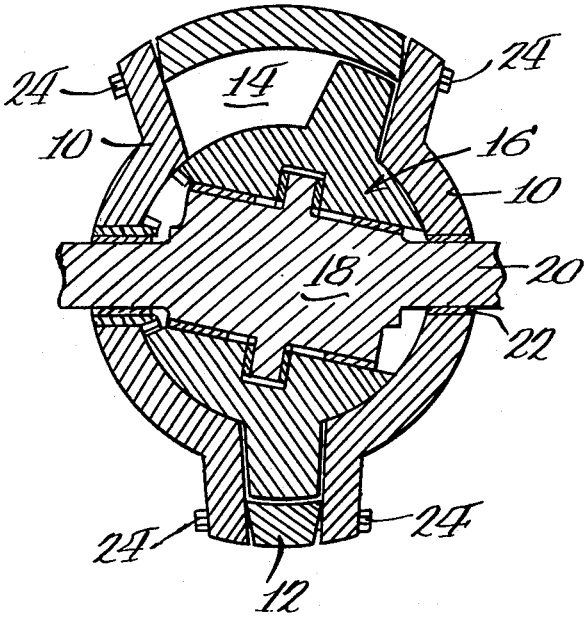
FIG. 1 is a sectional view of a slant axis rotary mechanism in the form of a four-cycle engine embodying the invention.

One embodiment of a mechanism incorporating the invention is illustrated in FIG. 1 in the form of a four-cycle slant axis rotary engine. However, it is to be understood that the invention is applicable to mechanisms other than engines, such as pumps or compressors. It is also applicable to rotary mechanisms other than slant axis rotary mechanisms, such as trochoidal mechanisms. Additionally, the invention will find substantial utility in reciprocating mechanisms, as will be seen.

The mechanism includes a housing defined by end housings 10 and an intermediate housing 12. The housings 10 and 12 define a chamber 14 which receives a rotary piston 16. The piston 16 is journalled on the angularly offset portion 18 of a shaft 20 which, in turn, is journalled in the end housings 10 by means of suitable bearings 22. Bolts 24 clamp the housings 10 and 12 in assembled relation.

Figure 2:
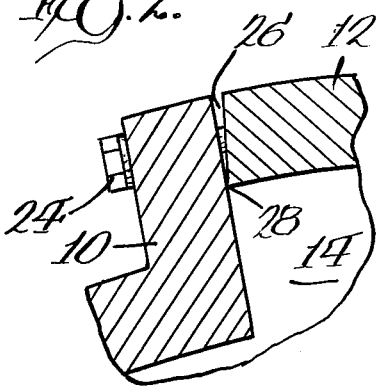
FIG. 2 is a fragmentary, enlarged, sectional view illustrating one embodiment of the invention as applied to the slant axis rotary mechanism.

Referring to FIG. 2, the intermediate housing 12, over a portion of its area of abutment with each of the end housings 10, is relieved as illustrated at 26. The relieved portion is remote from the chamber 14 so that upon tightening of the bolts 26, maximum contact stress between the housings 10 and 12 will occur at a point 28 coinciding substantially with the periphery of the chamber. As a consequence, the possibility of hot gases seeping between the housing parts 10 and 12 at their point of abutment to damage any seals employed therebetween (not shown) is eliminated.

The relieved portion 26 illustrated in FIG. 2 is in the form of a taper. As illustrated, the taper is flat and will typically be on the order of a deviation of 0.1° to 0.3° from a flush fit with the end housing 10. However, it is to be understood that the invention is not restricted to the use of flat tapers, it being possible, and in some instances desirable, to use other forms of tapers. For example, for certain types of stress distribution a hyperbolic taper could be employed.

Figure 3:
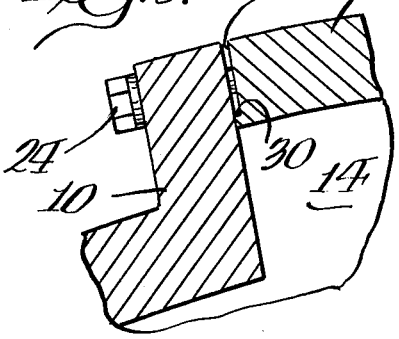
FIG. 3 is a fragmentary, enlarged, sectional view of a modified embodiment of the invention as applied to a slant axis rotary mechanism.

Turning now to FIG. 3, a modified embodiment of the invention is illustrated. In the embodiment of FIG. 3, a relief 26' is formed in the intermediate housing 12 remote from the chamber 14. The relief 26' is in the form of a step 30.

Figure 4:
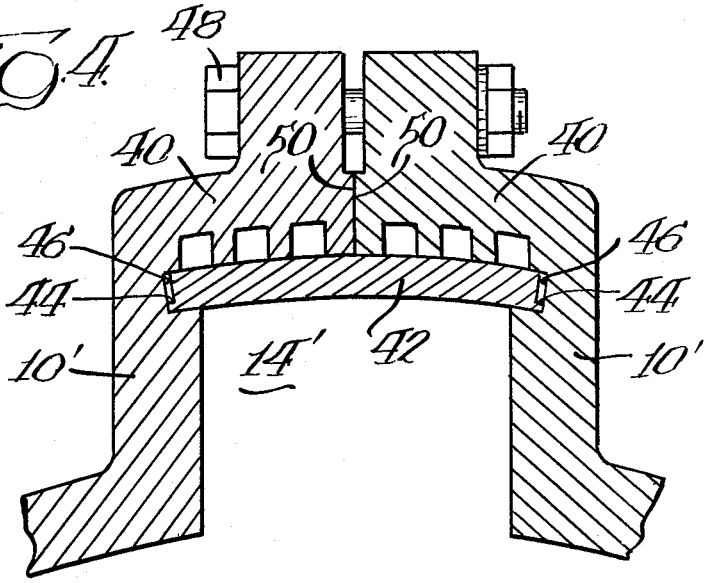
FIG. 4 is a fragmentary, enlarged, sectional view of still another embodiment of the invention.

FIG. 4 illustrates a further embodiment of the invention in a rotary mechanism omitting an intermediate housing. Specifically, two end housings 10' are employed and each includes a peripheral, inwardly directed backing flange 40 which together back a replaceable liner 42. The liner 42 together with the end housings 10' define a chamber 14'.

As can be seen, each end of the liner 42 is provided with a relief in the form of a step 44 for receipt in a groove 46 in the corresponding one of the end housings 10'. A series of bolts 48 clamp the end housings 10' together, as illustrated, and it is to be noted that a relief in the form of a step 50 is provided in each of the end housings 10' remote from the chamber 14'. Thus, upon tightening of the bolts, high contact stresses will result where the steps 44 on the liner 42 engage the end of the grooves 46 to eliminate gas leakage problems. Similarly, high contact stresses will exist at the steps 50. Of course, it is to be understood that tapers could be employed in lieu of the steps if desired.

Figure 5:
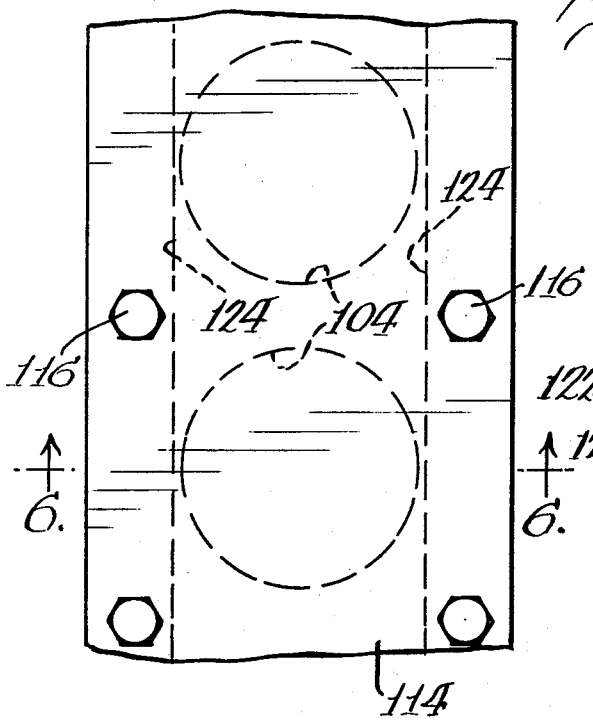
FIG. 5 is a fragmentary, plan view of a reciprocating mechanism embodying the invention.
Figure 6:
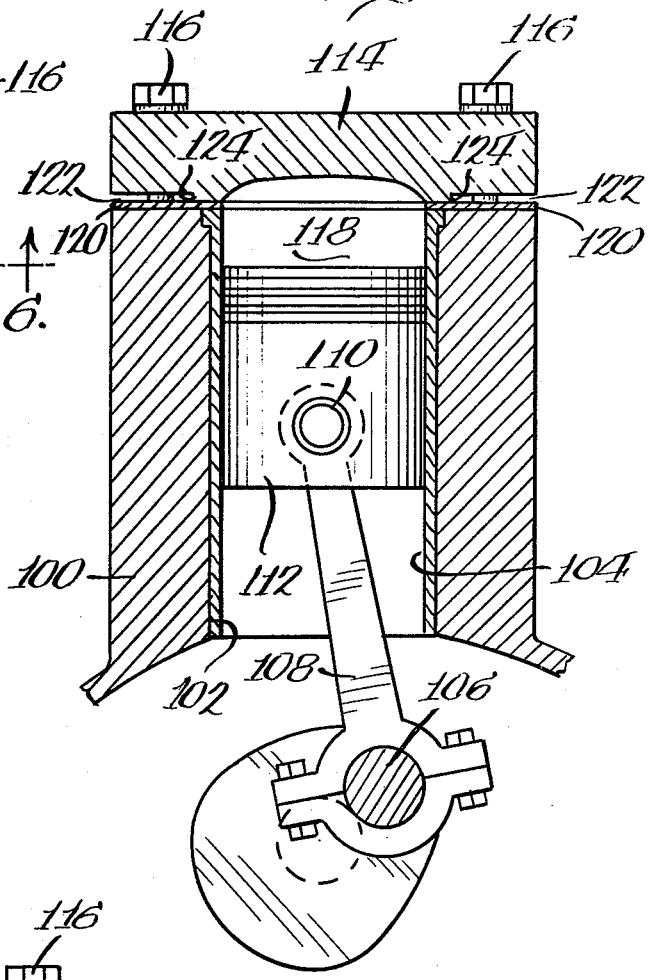
FIG. 6 is a sectional view taken approximately along the line 6—6 of FIG. 5.

FIGS. 5 and 6 show a further embodiment of the invention as applied to an in-line reciprocating engine. The engine includes a block 100 having a series of bores 102 therein, each receiving a liner 104. A crank shaft eccentric 106 journals a connecting rod 108 which, in turn, is connected by a wrist pin 110 to a piston 112 reciprocal within the liner 104.

A head 114 is secured as by bolts 116 to the block 100 and in connection with the liner 104 defines a chamber 118. As illustrated, a gasket 120 may be disposed between the head 116 and the block 100.

Both sides of the head 114 are relieved as at 122 along the length of the head 114. As seen in FIGS. 5 and 6, each of the reliefs 122 is defined by a small step 124 similar to the step described in connection with the descriptions of the embodiment of FIGS. 3 and 4. Again, tightening of the bolts 116 will generate high contact stress in the vicinity of the steps 124 to eliminate concern for manufacturing tolerances and/or relative rigidities of materials including the material of which the gasket 120 is formed.

Figure 7:
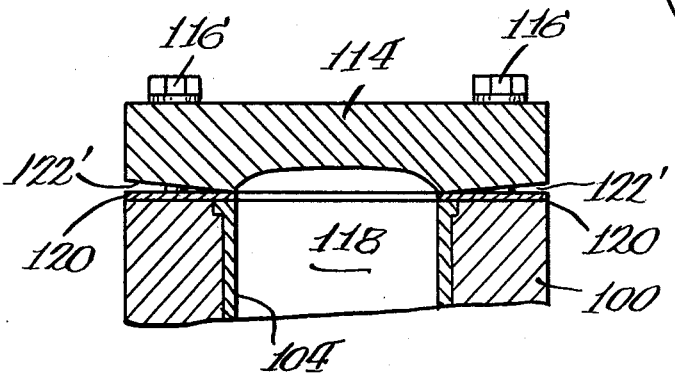
FIG. 7 is a fragmentary sectional view of a modified embodiment of the invention as applied to the reciprocating mechanism.

Turning to FIG. 7, a modified embodiment is illustrated. The relief formed in the head 114 is designated 122' and is formed in both sides thereof in much the same fashion as illustrated in FIG. 6. However, each of the reliefs 122' is in the form of a taper generally along the lines of that described previously in connection with the embodiment of FIG. 2. Again, excellent contact stress will result.

From the foregoing, it will be appreciated that the edge loading provided by use of the invention is such that sufficient contact stress will be maintained over a prolonged period. Even though the parts may fret, because the loading is provided through elastic deformation of the parts including the head and/or the bolts, even considerable yielding and/or fretting of the components can be accommodated through appropriate application of torque to the bolts. In general, in order to preclude distortion upon assembly of the components, it is desirable that they be finish machined when under a load similar to that to which they would be subjected in use. Where one or more of the parts will be provided with valve seats as, for example, if overhead valves are employed in the embodiment illustrated in FIGS. 5–7 in the head 114, the head should be clamped under a load identical to that loading to which it will be subjected when applied to the block at the time the valve seats are ground.

What is claimed is:

1. In an engine including two, abutting housing members sealingly engaging each other and defining a chamber receiving a piston, and means clamping said members together, the improvement wherein at least one of said members is relieved over a portion of its area of abutment with the other member, said relieved portion being remote from said chamber and wherein said clamping means includes means applying a clamping force to said members at a location aligned with said relieved portion and remote from the point of engagement of said members and in sufficient amounts to elastically deform said members to generate high contact stresses at their point of engagement immediately adjacent said chamber to effect a gas-tight seal.

2. The engine of claim 1 wherein said relieved portion is defined by a step.

3. The engine of claim 1 wherein said one member is a cylinder head.

4. The engine of claim 1 wherein said engine is a rotary engine and said one member is an intermediate housing member disposed between two end members.

5. The engine of claim 1 wherein said one member is a replaceable liner, and means backing said liner.

6. The engine of claim 1 wherein said relieved portion is defined by a taper.

7. The engine of claim 6 wherein said taper subtends an angle of about 0.1° to 0.3°.

* * * * *